United States Patent [19]

Elliott

[11] Patent Number: 4,745,650

[45] Date of Patent: May 24, 1988

[54] METHOD OF BURPING A WATERMATTRESS AND TUCKING A SHEET BETWEEN SAID WATERMATTRESS AND A SURROUNDING FRAME

[76] Inventor: Francine A. Elliott, 1047 Waverly Ave., Holtsville, N.Y. 11742

[21] Appl. No.: 78,208

[22] Filed: Jul. 27, 1987

[51] Int. Cl.[4] ..... A47C 27/08

[52] U.S. Cl. ..... 5/508; 5/451; 81/488; 294/1.1

[58] Field of Search ..... 5/508, 451, 452, 1; 24/72.5; 81/488; 294/1.1, 15; D8/14

[56] References Cited

U.S. PATENT DOCUMENTS

| | | | |
|---|---|---|---|
| D. 275,540 | 9/1984 | Barkow | D8/14 |
| 2,281,736 | 5/1942 | Wittenburg | 81/488 |
| 2,774,178 | 12/1956 | Nelson | 81/488 |
| 4,520,518 | 6/1985 | Reaser | 5/508 |
| 4,535,496 | 8/1985 | Parker | 5/508 |

OTHER PUBLICATIONS

"Englander" Owner's Manual, p. a, published 3/83 (or earlier) by Englander Mattress Co., 163 Avenue A, Bayonne, NJ. 07002.

*Primary Examiner*—Alexander Grosz
*Attorney, Agent, or Firm*—Leonard Belkin

[57] ABSTRACT

Method and apparatus for burping a watermattress and for tucking a sheet under the mattress of a waterbed consisting of a tool and its use for such purpose. The tool is a flat, rectangular member made of a self-lubricating plastic material and about ¼ inch in thickness with rounded edges to prevent damage to the mattress. The tool is used by inserted a corner under the mattress and sliding the tool along the edge of the mattress to tuck the sheet under.

1 Claim, 1 Drawing Sheet

METHOD OF BURPING A WATERMATTRESS AND TUCKING A SHEET BETWEEN SAID WATERMATTRESS AND A SURROUNDING FRAME

BACKGROUND OF THE INVENTION

This invention relates to method and apparatus for making up a water bed, and more particularly to a method and a tool for facilitating the folding and tucking in of sheets in a mattress which is filled with a liquid.

A typical waterbed consists of a mattress which is filled with a liquid, a frame sturdy enough to support the mattress, and quite often a system for maintaining the temperature of the liquid within the mattress.

The mattress usually is made from a plastic material which is strong enough to contain the liquid, customarily water, and as a result the mattress is quite heavy.

The waterbed has become quite popular because of its perceived advantages of enhancing sleep and alleviating certain physical conditions. However, the weight of the mattress makes it difficult to make up the bed, that is, to tuck a sheet between the frame and mattress deep enough so that water pressure will hold it in place. Since the average waterbed mattress is thicker than the conventional mattress, fitted sheets designed for the conventional mattress do not readily fit on the waterbed, as well as the fact that it is difficult to put the sheet on due to the frame construction.

Because of the weight of the mattress containing the water and the relative stiffness or rigidity of the mattress, it is awkward and sometimes difficult to tuck between the frame and the mattress. In addition, the problem is compounded for a person with long finger nails and who wishes to prevent damage to those nails.

There have been attempts to alleviate this particular problem, one such solution being shown in U.S. Pat. No. D. Des. 275,540 which shows a device for tucking waterbed bedclothes. The device shown in that patent has a handle which is awkward to grasp and use in carrying out the typical motions required in tucking in bed sheets, and in addition, the aspect ratio illustrated also appears to be inappropriate for such application. Furthermore, the patent lacks an adequate technical description of the device so that the details of construction and use are not disclosed.

SUMMARY OF THE INVENTION

In the present invention, problems associated with previous methods and apparatus for tucking in the bed sheets of waterbeds are overcome or substantially reduced by providing method and apparatus for making use of a tool better able to conveniently and readily tuck in the bed sheets of a waterbed with less deleterious impact on the fingers and nails of the person making the bed. The method and apparatus of this invention are also useful in the elimination of air bubbles trapped within the mattress.

In accordance with preferred embodiments of this invention there is provided method and apparatus for tucking in a bed sheet in a waterbed employing a tool constructed of a self-lubricating plastic material sufficiently strong so as not to break when pressed against the mattress and yet sufficiently flexible to conform to the bending of the mattress along its edges, and wide enough to catch enough of the sheet but sufficiently shallow as not to require penetration more than the minimum necessary to tuck in the sheet.

It is therefore a principal object of this invention to provide an improved method of tucking in the bed sheet of a waterbed.

Another object of this invention is to provide a new tool for use in tucking the sheet of a waterbed.

Other objects and advantages of this invention will hereinafter become obvious from the following detailed description of preferred embodiments of this invention.

DETAILED DESCRIPTION OF THE PREFERRED EMBODIMENTS

Figure 1:
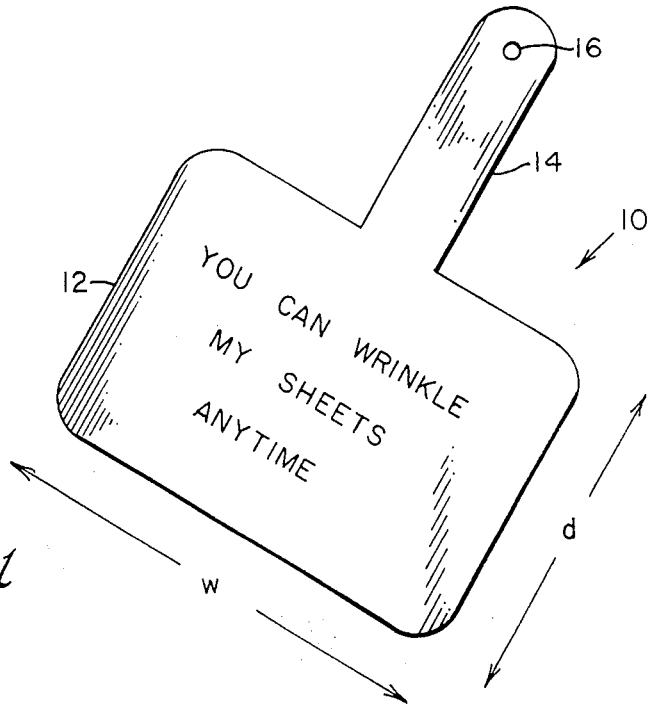
FIG. 1 is an isometric view of a tool embodying the principles of this invention.

Referring to FIG. 1 there is illustrated a tool 10 embodying the principles of this invention.

Tool 10 consists of a rectangular portion 12 and a handle 14 with a hole 16 for hanging tool 10 from a nail or other member near the waterbed.

Figure 2:
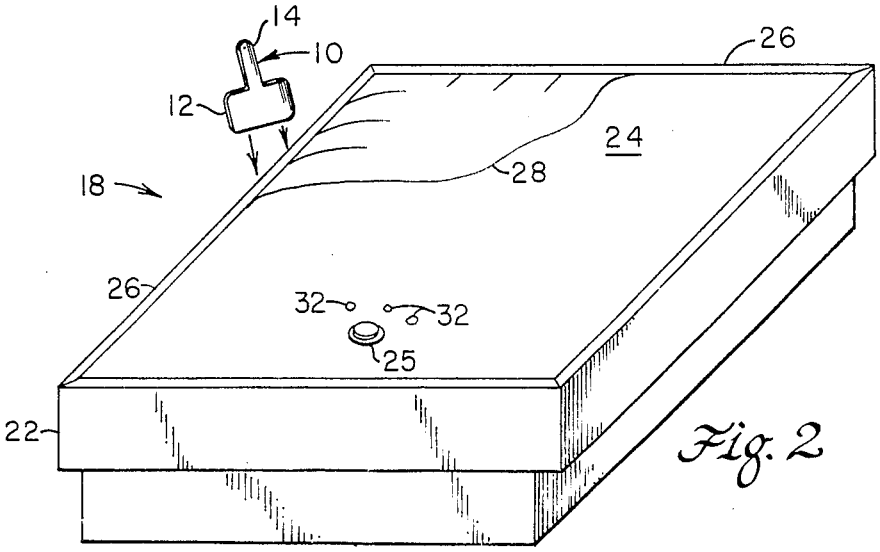
FIG. 2 is an isometric view of a waterbed showing the use of the tool in FIG. 1 with the sheet partially cut away.

As seen in FIG. 2, waterbed 18 consists of a frame 22 in which mattress 24 is situated. Mattress 24 is provided with a valve 25 where the water is inserted or withdrawn. Frame 22 has side walls 26, with sheet 28 placed over mattress 24. The purpose of this invention is to facilitate the pushing in of the ends of sheet 28 drawn between mattress 24 and side walls 26. In order to accomplish this, tool 10 is grasped by handle 12 and pushed down between walls 26 and mattress 24 resting on frame 22 forcing the edges of sheet 28 into the spaces between mattress 24 and side walls 26.

In order to render tool 10 effective for the purposes of this invention, tool 10 must be made of a self-lubricating plastic. Such a material is defined in the "Guide to Selecting Engineered Materials" published by ASM International (1987 Edition) as a plastic with inherent lubricity along with low coefficients of friction. Examples of such materials are acetals, fluoroplastics, high molecular weight, high density polyethylenes, nylons, among others listed.

In addition, tool 10 must be of sufficient thickness to slide between the very heavy mattress 24 and side walls 26 without breaking and yet be sufficiently flexible to conform to the slight distortion of mattress 24 which occurs when tool 10 is inserted.

A further requirement of tool 10 is that its width, shown as dimension w in FIG. 1 be sufficient to engage at least enough sheet to accomplish adequate tucking. This width has been found to be at least eight inches, but no more than about ten inches. An important feature of the design of tool 10 is that it is very shallow, that is, its depth, indicated by dimension d is just sufficient to get the edge of the sheet 28 completely tucked in but not large enough to require exertion against too much of mattress 24 pressing against frame 22. Dimension d should be no more then five and one half inches. The self lubricating characteristic of the material out of which tool 10 is constructed is an important aspect of the invention because of the weight of mattress 18 being filled with water. The pressure of mattress 24 against side walls 26 holds sheet 28 in place as tool 10 is withdrawn.

It has been found also that tool 10 to be effective must be sufficiently thick to avoid risk of breakage yet thin enough to reduce the effort required to insert it to a manageable level. This ideal thickness has been found to be about ¼ inch. In addition, in order to avoid any possible damage to the mattress which typically would be made from a plastic material, the edges of tool 10 are rounded.

In using tool 10, as seen in FIG. 2, the latter is inserted at an angle of about 30 degrees with the side of mattress 24 to gradually tuck sheet 28 in as tool 10 is slid along the length of mattress 24. The corner of tool 10, as seen in FIG. 2 would be inserted with the sheet in front of it, pushed in as shown by the arrows, and the tool moved down the length of the mattress to get the free edges of sheet 28 completely tucked in. The flexibility of tool 10 to accomodate distortion in mattress 24 as the tool 10 is inserted, in combination with its self lubricating characteristic and the particular dimensional requirements noted above makes it possible to tuck sheet 28 in without excessive effort and minimum risk of finger nail breakage.

Figure 3:
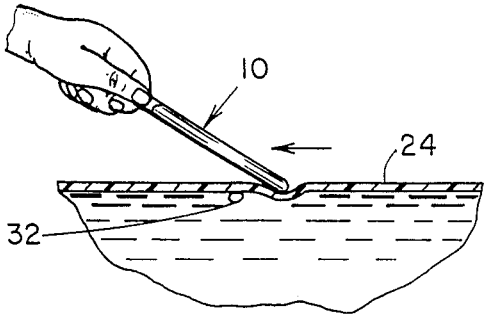
FIG. 3 is a side view in section of a portion of the mattress with the tool being used to remove trapped air.

One of the useful advantages of tool 10 is that, prior to placing sheet 28 on mattress 24, bubbles 32 of air located along the top surface of the water within mattress 24 can by using tool 10, be pushed toward valve 25 and the trapped air removed or burped from within mattress 24. Tool 10 can be placed with its bottom edge on the top of mattress 24 as seen in FIG. 3, pressing in on mattress 24 and moved behind each bubble 32 moving the latter toward valve 25.

While only certain preferred embodiments of this invention have been described it is understood that many variations of this invention are possible without departing from the principles of this invention as defined in the claim which follows.

What is claimed is:

1. The method of preparing a waterbed for use said waterbed comprising a water filled mattress surrounded by a frame comprised of sidewalls, said method comprising steps of using a tool to remove trapped air from within said mattress, said tool consisting of a flat, rectangular member made of a self-lubricating plastic with rounded edges to prevent damage to said mattress and having a flat handle flush with the sides of said member and sufficiently thin to permit grasping around said handle, the thickness of said tool being about ¼ inch, the width being at least eight inches but no more than about ten inches, and the depth being no more than about five and one-half inches, the method comprising grasping said handle and placing a long side of said tool against the top surface of said mattress thus creating a temporary depression, and moving said tool to urge trapped air bubbles toward a valve in said mattress for removal, and then tucking the edge of a sheet between said mattress and said sidewalls of said frame with said tool at an angle of about thirty degrees with said mattress, and sliding said tool at said thirty degree angle along the perimeter of said mattress thereby tucking in the edge of said sheet between said mattress and said sidewall.

* * * * *